United States Patent [19]

Pinson

[11] 4,411,023

[45] Oct. 25, 1983

[54] SMOKE PROTECTIVE HOOD

[76] Inventor: Jay D. Pinson, 6520 Kingland Ct., San Jose, Calif. 95120

[21] Appl. No.: 310,651

[22] Filed: Oct. 13, 1981

[51] Int. Cl.[3] ..... A42B 1/04; A62B 23/00

[52] U.S. Cl. ..... 2/7; 2/205; 128/206.15

[58] Field of Search ..... 2/206, 202, 205, 7, 2/171, 4; 128/206.12, 206.15, 206.17, 206.19

[56] References Cited

U.S. PATENT DOCUMENTS

| | | | |
|---|---|---|---|
| 1,856,879 | 5/1932 | Lufkin | 2/7 |
| 2,910,979 | 11/1959 | Shanty et al. | 128/206.12 X |
| 3,789,839 | 2/1974 | Lund et al. | 2/206 X |
| 4,098,270 | 7/1978 | Dolby | 128/206.12 |
| 4,133,055 | 1/1979 | Zebuhr | 2/411 |
| 4,207,882 | 6/1980 | Lemere | 128/206.15 |
| 4,231,118 | 11/1980 | Nakagawa | 2/205 X |

*Primary Examiner*—Peter P. Nerbun

*Attorney, Agent, or Firm*—Jack M. Wiseman

[57] ABSTRACT

A hood for protecting the wearer from poisonous fumes and the like includes a respirator having a portion arranged to be gripped in the mouth of the user to hold it in place.

18 Claims, 6 Drawing Figures

SMOKE PROTECTIVE HOOD

SUMMARY OF THE INVENTION

A smoke protection hood includes a respirator which features a mouthpiece adapted to be gripped in the mouth of the user to hold the hood in effective position.

BACKGROUND OF THE INVENTION

It is well known that most of the lives lost in fires are lost due to smoke inhalation, and that these deaths occur because no means has been made readily available which will give a person, who is caught in a fire, adequate protection from smoke inhalation for the relatively short period of time necessary to escape the fire. The present invention contemplates the provision of a mask or hood that can be conveniently stored, is simple to use, and is effective to give the user protection from smoke inhalation for approximately fifteen minutes.

Hoods have been provided for protecting the wearers from various dangerous conditions including smoke inhalation, and the hood disclosed in the patent to Nakagawa U.S. Pat. No. 4,231,118 is purported to provide protection from fire, smoke and poisonous gases. Other hoods and similar protective devices are disclosed in the patents to Lufkin U.S. Pat. No. 1,856,879, Lund et al. U.S. Pat. No. 3,789,839 and Zebuhr U.S. Pat. No. 4,133,055.

It is, of course, of utmost importance to the wearer of a smoke protective hood that he be able to breathe easily and efficiently, and it is therefore desirable that the mouthpiece be precisely located relative to his or her mouth. It is evident that, if a hood is too large or too small for the head of the wearer, the mouthpiece will be displaced from his mouth and will have to be continuously adjusted to give him a feeling that he is getting enough air under the circumstances.

None of the above-mentioned patents disclose any means for locating the mouthpiece near the user's mouth and it is an important object of the present invention to provide such means.

DESCRIPTION OF A PREFERRED EMBODIMENT

Figure 1:
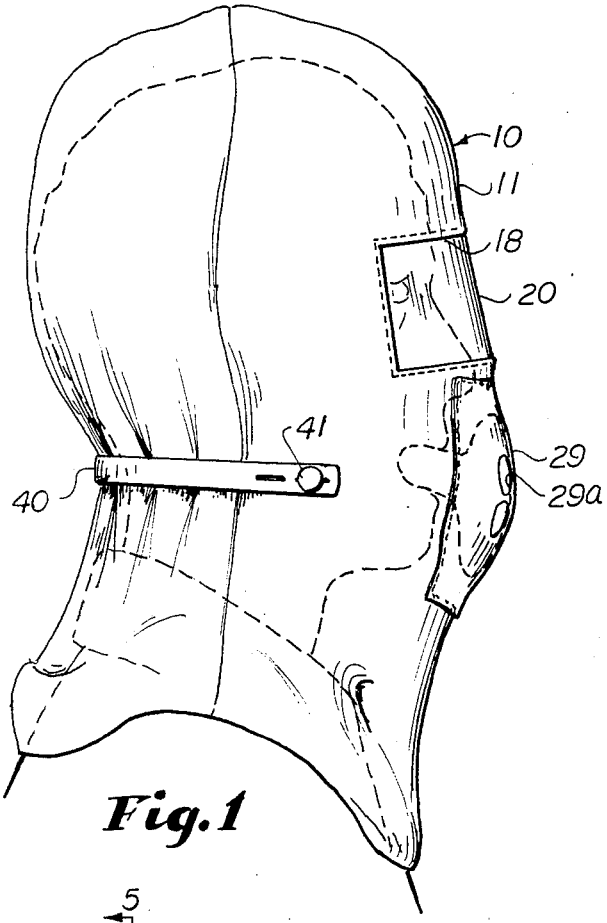
FIG. 1 is a side elevation of the hood of the present invention, the head of the wearer of the hood being shown in phantom lines.

In FIG. 1 the reference numeral 10 indicates generally the mask or hood of the present invention which includes a front panel 11 and a rear panel 12 secured together along their side and top edges. The panels are cut so that, when the side and top edges are joined, an opening is formed at the lower end through which the head of the user can be inserted into the hood, and a dome-like upper portion is formed that is adapted to comfortably receive the head. The lower portion of the hood is cut rather full so that the lower edge of the hood engages the shoulders, back and chest of the user.

Figure 3:
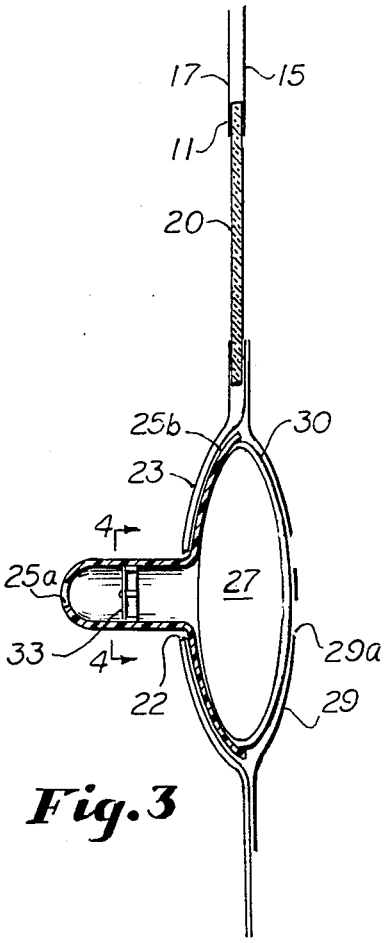
FIG. 3 is a diagrammatic exploded section taken along line 3—3 of FIG. 2.

The front and rear panels 11 and 12 are identical in construction, consisting of an outer layer 15 (FIG. 3) of flexible, fire-retardant, non-combustible, heat-reflective vinyl material, and an inner layer 17 of polyester cloth. The layers 15 and 17 of each panel are effective to insulate the wearer from the outside heat, and the fact that the layers are slightly spaced apart augments this insulating action. An opening 18 is provided in the front panel 11, and a window 20 of flexible, transparent, non-flammable, plastic material is secured in the opening between the inner and outer layers by a line of stitching surrounding the opening. The stitching passes through the plastic window and through both the inner and outer layers of the front panel 11. A second opening 22 is provided in a rearwardly-bulged portion 23 of the front panel 11, and a tubular mouthpiece 25 extends through this opening. The mouthpiece has an opening **25*a* at one end and is open at the other end. An annular dish-shaped retainer plate 25*b* is integrally formed on the open end of the mouthpiece, and this retainer plate is disposed between the outer layer 15 of the front panel and one curved wall of a cloth bag 27 that contains chemicals which filters the air entering the mask. A rectangular plastic cover 29 is secured to the front panel to hold the bag 27 in place. The cover 29 has a plurality of holes 29*a* therein which permit air to enter the mask. A multi-layer filter element 30 is disposed between the bag 27 and the cover 29. This element, which may be made of layers of fiberglass cloth, is generally circular in configuration and is bonded to the outer peripheral edge of the retainer plate 25*b***.

Figure 4:
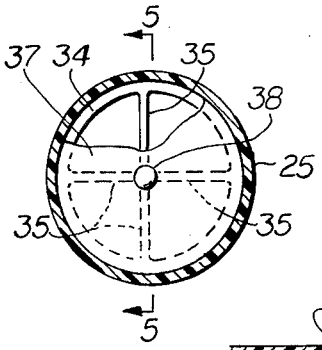
FIG. 4 is an enlarged section taken along line 4—4 of FIG. 3.
Figure 5:
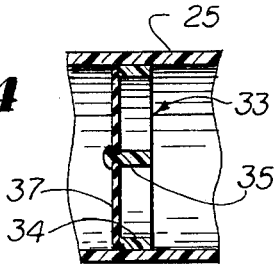
FIG. 5 is a longitudinal section taken along line 5—5 of FIG. 4.
Figure 6:
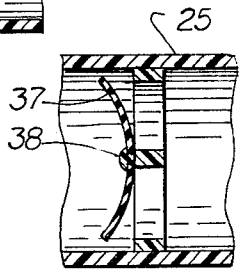
FIG. 6 is a section similar to FIG. 5 but showing a different operating position of the valve.

A valve 33, which includes an annular plastic frame 34 (FIG. 4) and four radial arms 35, is mounted in the tubular mouthpiece 25, the annular frame being dimensioned to snugly engage the inner wall of the mouthpiece. If desired, the filter can be secured in the mouthpiece by a plurality of small setscrews. The valve includes a circular membrane 37 (FIGS. 5 and 6) that is fastened to the frame 34 by a screw 38. The membrane is made of a flexible material, such as a thin sheet of vinyl and is adapted to flex rearwardly to the open position of FIG. 6 when the user of the hood inhales, and is adapted to move to the passage-closing position of FIG. 5 when the user exhales. Thus, air entering the mask will be permitted to move inwardly through the filter cloth 30 and the filter bag 27 while exhaled air will not be permitted to pass outwardly into the filter bag.

Figure 2:
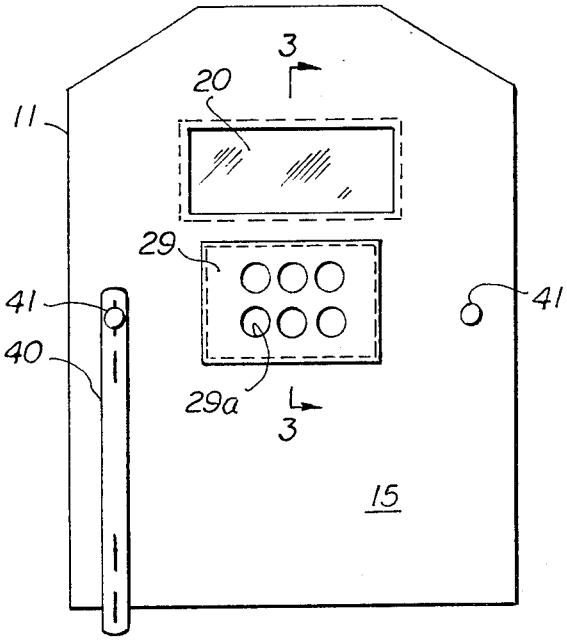
FIG. 2 is a diagrammatic front elevation of the hood of FIG. 1.

To help hold the bag 27 and the mouthpiece 25 firmly in place, an elastic strap 40 (FIG. 2) is adapted to be removably secured to buttons 41 on the front panel of the mask. When the elastic band is fastened around the back of the mask, substantially as shown in FIG. 1, the mouthpiece will be resiliently urged toward the user's face so that it can be effectively gripped by the user. A plurality of slits may be provided at graduated distances from the ends of the strap 40 so that a suitable setting may be selected by the user.

The filter element 30 and the bag of chemicals 27 comprise a respirator unit, while the mouthpiece 25 and the cover 29 cooperate with the wall 11 to hold the respirator in place. The bag 27 may contain chemicals, such as cocoanut charcoal, silica and almondine, that are effective to absorb the poisonous gases encountered in a fire. The multi-layer cloth filter element 30 is preferably made of a plurality of layers of thin fiberglass cloth, but it will be evident that other sheet material may also be used as long as it has the ability to filter particulate material and heavy gases. The cloth bag 27 itself, independent of the chemicals, acts as a filtering element. All elements of the respirator and the surrounding, non-combustible materials must have sufficient porosity or be suitably apertured to permit the passage of air.

The hood itself may be made of material that is not only non-combustible but also has reflective properties to act as a insulator. The transparent window could be made from a material that has a reflective outer surface but is optically clear.

If desired, a draw-string can be threaded through an appropriate loop or a continuous passage around the hood at the neck area so that the bottom of the hood can be effectively closed by drawing the hood close around the neck area of the wearer without preventing the exhaling of air by the wearer and enabling the venting of the exhaled air to atmosphere through the bottom of the hood.

I claim as my invention:

1. In combination, a hood, means providing a respirator in one wall of said hood, said respirator including a gas-absorbing unit, a mouthpiece having a positioning member adapted to be gripped in the mouth of the wearer, said mouthpiece including a generally flat front portion abutting said gas-absorbing unit and said positioning member projecting rearwardly from said front portion for insertion into the mouth of the wearer.

2. The combination of claim 1 wherein said positioning member is apertured to facilitate the breathing of the wearer of the hood.

3. The combination of claim 2 wherein said positioning member is a rearwardly-extending member generally tubular in cross-section, and further comprises a valve disposed in the tubular cross-section of said positioning member and arranged to permit the flow of gas only toward the rearward end of the member.

4. The combination of claim 1 wherein said gas-absorbing unit is a porous cloth bag containing gas-absorbing material and wherein said generally flat portion of said mouthpiece is a dish-shaped member disposed closely adjacent the rear surface of said bag.

5. The combination of claim 4 wherein said dish-shaped member has walls surrounding a central opening and wherein said positioning member comprises a generally cylindrical wall forming a continuation of the walls of said dish-shaped member that surrounds said central opening and providing a generally tubular section projecting rearwardly from the aperture.

6. In a protective hood of the type in which a view port and a respirator are mounted in apertures in the forward wall of the hood, the improvement which comprises a one-way valve associated with the respirator and permitting flow of gas toward the face of the wearer of the hood while restricting flow away from the face of the wearer, said valve having an annular frame and said hood further comprising a tubular positioning member enclosing said valve and providing an exterior surface adapted to be gripped in the mouth of the wearer of the hood.

7. A protective hood comprising a front wall, a rear wall having a configuration similar to the configuration of said front wall, means for securing said walls together along the top and side edges, each of said walls being multi-layered and including an outer layer of flexible, fire-retardant, non-combustible, heat-reflective material and an inner insulating layer of polyester cloth, means defining a first and second aperture in said front wall, a transparent non-flammable eyepiece mounted in said first aperture, a respirator secured in said second aperture, and a respirator-positioning member with a mouth gripping member mounted in said front wall adjacent said respirator.

8. The combination of claim 7 wherein said respirator including a container containing gas-absorbing material, and a filter element adjacent one face of said container.

9. The combination of claim 8 wherein said filter element comprises a multi-layered cloth of fiberglass.

10. The hood of claim 1 further comprising gathering means near the lower end of the hood for drawing in the lower portion of the hood and locking it closed around the neck area of the wearer.

11. The hood of claim 10 wherein said gathering means includes a strap adapted to be releasable secured at one end to the outer surface of said hood.

12. The hood of claim 10 wherein said gathering means includes a drawstring encircling the lower portion of the hood.

13. A smoke protective hood comprising:

(a) non-combustible cover means disposed over and completely around the head of a wearer with the bottom thereof extending to the neck of the wearer;

(b) a respirator including a gas-absorbing unit disposed in one wall of said cover means; and (c) a valve disposed in a path of communication between said gas-absorbing unit and the interior of said cover means to permit the flow of gas toward the face of the wearer through said gas-absorbing unit while restricting flow away from the face of the wearer through said gas-absorbing unit, gas inhaled by the wearer from the atmosphere advances through said gas-absorbing unit and said valve and gas exhaled by the wearer is vented from said cover means to the atmosphere from the bottom of said cover means.

14. A smoke protective hood as claimed in claim 13 and comprising a mouthpiece having a positioning member adapted to be gripped by the mouth of the wearer, said mouthpiece communicating with said gas-absorbing unit and said valve, said valve being disposed between said mouthpiece and said gas-absorbing unit.

15. A smoke protective hood as claimed in claim 14 wherein said respirator, said valve and said mouthpiece are disposed in alignment.

16. A smoke protective hood as claimed in claim 14 wherein said respirator, said valve and said mouthpiece are disposed in abutting relation.

17. A smoke protective hood as claimed in claim 13 and comprising a drawstring encircling the lower portion of said cover means closing the lower portion of said cover means around the neck of the wearer and permitting the exhalation of gas by the wearer to be vented to the atmosphere from the bottom of the cover means.

18. A smoke protective hood as claimed in claim 14 and comprising a drawstring encircling the lower portion of said cover means closing the lower portion of said cover means around the neck of the wearer and permitting the exhalation of gas by the wearer to be vented to the atmosphere from the bottom of the cover means.

* * * * *